United States Patent [19]

Burger

[11] Patent Number: 4,577,559

[45] Date of Patent: Mar. 25, 1986

[54] ROTARY WEB PRINTING MACHINE

[75] Inventor: Rainer Burger, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 651,676

[22] Filed: Sep. 18, 1984

[30] Foreign Application Priority Data

Sep. 29, 1983 [DE] Fed. Rep. of Germany ..... 3335235

[51] Int. Cl.[4] ..... B41F 7/10

[52] U.S. Cl. ..... 101/221; 101/228

[58] Field of Search ..... 101/178, 179, 180, 181, 101/219, 220, 221, 225, 228, 216

[56] References Cited

U.S. PATENT DOCUMENTS

| | | | |
|---|---|---|---|
| 2,070,265 | 2/1937 | Foster | 101/221 X |
| 4,325,301 | 4/1982 | Grosshauser | 101/228 X |

FOREIGN PATENT DOCUMENTS

| | | | |
|---|---|---|---|
| 0053226 | 6/1982 | European Pat. Off. . | |
| 2741596 | 3/1978 | Fed. Rep. of Germany . | |
| 2932087 | 2/1981 | Fed. Rep. of Germany . | |
| 2007156 | 5/1979 | United Kingdom | 101/148 |

OTHER PUBLICATIONS

Techniken, Systeme, Maschinen by FREI, p. 7 (Technology Systems, Machines), 1979.

*Primary Examiner*—Charles A. Pearson

*Attorney, Agent, or Firm*—Frishauf, Holtz, Goodman & Woodward

[57] ABSTRACT

To provide ready access to printing cylinders, including, for example, a satellite cylinder (4), plate and blanket cylinders, and inkers and dampers of a printing system in which the printing couples and associated inkers and dampers are located, essentially, in Y configuration, the side walls of the machine are constructed to have two upstanding arms (2) and only a single support leg (3) to form an amputated or truncated H structure, leaving a space (S) beneath one of the upstanding arms (2) which provides ready access to an operator (I). The upstanding arm (2) which is not above the leg (3) is supported by a post or column structure 20 which, preferably, has a platform (22) thereon. The paper web can be guided in an upwardly extending path (A, B), from either side of the machine, and access to all cylinders and rollers is provided from the left and right side of the machine, respectively, under all paper path (A, B) conditions.

8 Claims, 1 Drawing Figure

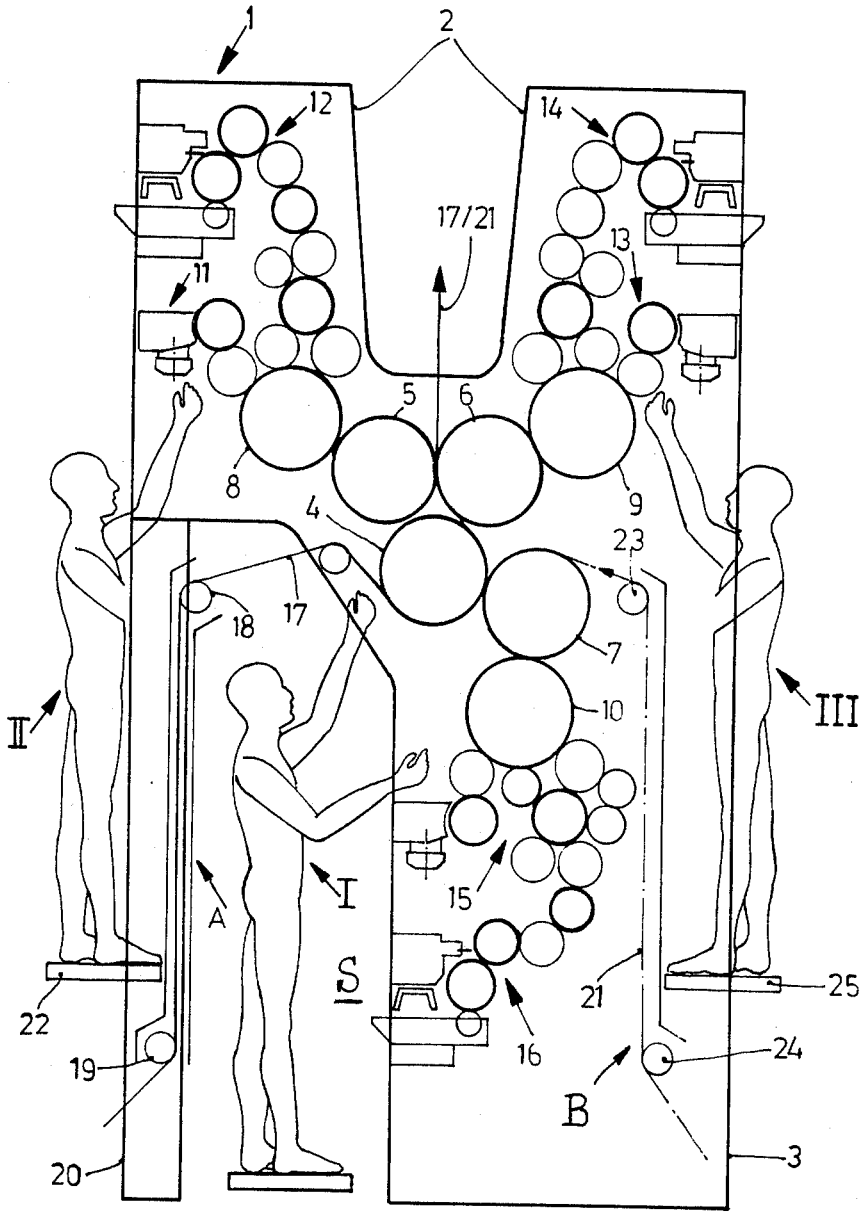
1
2
12
14
17/21
13
11
5
6
8
9
4
23
18
17
7
10
II
III
I
A
15
S
21
25
22
16
24
19
B
20
3

ROTARY WEB PRINTING MACHINE

The present invention relates to a rotary printing machine for printing on a web, in which printing cylinders and rollers are located in two spaced side walls, the printing machines and rollers being arranged in approximately Y configuration. The substrate or web which is to be printed is carried in vertically upwardly extending direction to the printing machine, the vertically upwardly extending portion forming an entrance or supply portion of the web to the printing machine.

BACKGROUND

A printing machine of the type above referred to specifically suitable for newspaper printing has been previously proposed, see "Techniken, Systeme, Maschinen" by Oskar Frei, published by Polygraph, page 7 ("Technology, Systems, Machines"). It has been found that, in dependence on the path of the web to the printing machine, either the upper cylinder and roller group or the lower cylinder and roller group are covered or shielded by the web, so that access to the respective roller groups is impaired.

It has previously been proposed to improve access to printing cylinders, rollers and the like by the printers and printing machine operators by providing height-adjustable platforms and the like. Lifting-type platforms, elevators and the like are very expensive, require precise guidance for effective operation, and introduce additional structural complexity, while being in the way of personnel, when not in use (see, for example, German Patent Disclosure Document DE-OS No. 27 41 596).

It has also been proposed to provide swinging guide systems which guide the web in respectively different paths, so that if the web is guided in one path, one printing system is accessible whereas, if the web is guided in another path, another printing system is accessible—see German Patent Disclosure Document DE-OS No. 29 32 087.

Such moving mechanism in which the various guide elements for the path of the web are changeable or movable introduces complexity and requires specific holding and adjustment arrangements for the respectively different guide paths of the web. Careful attention to the guide path by the operator is required, thus placing an additional level of skill on the printer. The basic construction has been improved—see, for example, European Patent Office Publication EP-OS Nos. 81 106,778.4. The structure proposed in this publication also requires adjustment and setting of the respective web guide rollers for the respectively different paths.

All the literature and publications are directed to printing systems of the H type, in which the side wall of the printing machines have two downwardly directed legs, and two upwardly directed arms, cross-connected by a solid portion which, usually, carries a satellite printing cylinder and the heavy printing rollers which, in the constructions described, usually are directed to offset printing machines, that is, blanket and plate cylinders. The upwardly directed arms, and one of the downwardly directed legs then carry the structures which are usually formed of combinations of lighter-weight rollers, that is, for example, the dampers and inkers for the printing systems.

THE INVENTION

It is an object to improve a newspaper printing machine of the basic type shown in the referenced textbook, in which the respective printing machine units or couples or combinations are readily accessible.

Briefly, side walls, which retain the respective cylinders and rollers of the printing machine, are constructed in the form of an essentially amputated or truncated H shape or distorted Y shape. The term "amputated H shape", as used in this application, is intended to convey the shape of an H in which one of the lower leg portions of the H has been removed or truncated or amputated, so that the structure, looked at by itself, would unstably stand on only one downwardly depending leg of the H. Expressed in another form, the shape is essentially that of an asymmetrical Y in which the upwardly extending slanting portion of one branch of the Y is essentially in alignment with the single downwardly extending leg. The side walls of this amputated H-shaped structure is supported, at the free end where, otherwise, the second leg of the U would be, by an open column or beam which also supports a guide roller over which the web can be passed. By replacing the side wall of the machine which, in accordance with prior structures, would have been a solid element by the open column, access to the printing couples and printing cylinders and rollers immediately facing the open space which will be formed by omitting the lower leg of the H is insured, thus permitting access by operators to the respective printing elements.

In accordance with preferred embodiments, standing platforms and/or access ladders to the respective printing units and elements thereof are preferably provided, supported for example on the side walls and/or the column structure which is located in the space left free by the omitted leg of the H.

DRAWING

The single FIGURE is a schematic side view of the arrangement of the cylinders and rollers used in the printing machine in accordance with the present invention.

DETAILED DESCRIPTION

Two side walls 1 are provided; only one of the side walls is visible in the drawing, the other being identical and spaced from the side wall visible in the drawing by the axial length of the cylinders of the cylinder plus such additional apparatus as is necessary to insure rotation of the respective cylinder and rollers. The machine is illustrated, by way of example, as a rotary offset printing machine. The machine has printing units including cylinders 4–9. These cylinders are located in approximately asymmetrical Y-shaped configuration. A common central impression cylinder 4, forming a satellite cylinder, is provided, about which blanket cylinders 5, 6, 7 are located. Each one of the blanket cylinders has a respective plate cylinder 8, 9, 10 associated therewith. Each one of the cylinder couples 5, 8; 6, 9; 7, 10 has an associated damper and inker 11, 12; 13, 14; 15, 16. The inkers and dampers 11, 12 and 13, 14 are located in the respectively upwardly directed arms 2 of the side wall 1. The lower leg 3 of the side wall 1 retains the damper 15 and the inker 16, associated with the printing couple 10, 7. All cylinders and rollers of the rotary printing machine are located between the side wall pairs 1.

As clearly seen in the drawing, the side walls 1 have approximately the shape of a one-legged H, defined above as an "amputated H", in which the remaining leg of the H is shown at 3, and the two upwardly directed arms as 2. The satellite cylinder 4 is located approximately centrally in the machine, and, if the amputated H is considered, alternatively, as a somewhat distorted Y, the satellite cylinder would be located approximately at the junction of the upwardly directed arms and the single downwardly extending support leg 3.

In accordance with the invention, a column or upwardly extending beam structure 20 is provided, located at the lower left portion of the left arm 2—with respect to the FIGURE—to support the machine. By replacing the side wall with an open column or post, a space S will become available beneath the left arm 2 which permits an operator I free access to the lower cylinders 7, 10 and the damper 15, and inker 16. The web 17 is guided, in accordance with one guide path, in a rising portion about paper guide rollers 18, 19 which are secured to and retained by the upstanding post or column 20, provided instead of the previously used base leg of an H structure in accordance with the prior art. The replacement of the base leg by a post or column structure 20 then provides the space S for the operator I while retaining the upwardly directed path A for the web, which is desirable in many printing operations for standing, while feeding a paper web to the printing machine.

The arrangement has another substantial advantage, namely by providing excellent access to the cylinder, and, likewise, are easily accessible. Preferably, a platform 22 or the like is located between the posts or columns 20—a pair of such posts or columns are provided, similar to the pair of side walls 1, of which only one is seen in the FIGURE—to permit an operator II to work on the upper cylinders 5–8 and the associated inker 11 and damper 12. If necessary, a short ladder and the like, with platforms of different heights, can be provided. The structure, as can be seen from the drawing, is substantially taller than the height of an average operator, platform 22 provides access to the elements in upper arms of the "amputated H".

The system is versatile and does not require, necessarily, the paper path A; a path 21, shown in chain-dotted lines, likewise is possible, in which the web is guided into the machine from the right side, over guide rollers 24, 23 located between the remaining legs 3 of the side walls 1 of the printing machine, for introduction between the blanket cylinder 7 and the satellite cylinder 4, and subsequent passage between the blanket cylinders 5, 6 in an upward direction, as shown by the arrow 17/21. The output or downstream path of the web, thus, will be identical regardless of whether the web is fed from the left or from the right. A further platform 25 can be provided between the legs 3, if necessary also in multiple form or with a ladder, to permit an operator III to work on the upper cylinders 6, 9, the damper 13, and the inker 14. The lower cylinders 6 and 9, as well as the cylinders 5 and 8, and the associated inkers and dampers, then are freely accessible from the left side. If the paper is fed as shown in the solid line 17, the lower cylinders 7, 10 and the associated damper and inker are accessible from either the left or right side, the upper printing unit 5, 8 and associated damper and inker are accessible from the left, and the printing unit 6, 9 and associated damper and inker are accessible from the right—all with reference to the FIGURE.

The structure, thus, provides universal accessibility to all cylinders and associated apparatus, such as the dampers and inkers, regardless of the path of the paper web; resetting of paper guide rollers or paper guide elements upon change in alignment or orientation of the path of the web is not necessary. The upwardly extending portion of path 21 is shown at B.

I claim:

1. Rotary newspaper web printing machine having a pair of side walls (1);

a plurality of cylinders and rollers (4–15) positioned and retained between said side walls, two of said cylinders (5, 6, 7; 4) forming, respectively, a printing cylinder and an impression cylinder for printing on a web (17, 21) being guided in an upward direction (A; B) for printing between said two cylinders, at least one of said rollers forming an inker roller, wherein the side walls (1) comprise an upright structure substantially taller than the height of an operator in essentially amputated H shape having two upwardly extending arms (2) and only one downwardly extending single support leg (3), located essentially in vertical alignment with one and only one of said arms (2) and leaving a free space (S) adjacent the single downwardly extending support leg (3) and beneath the one of said upwardly extending arms which is not essentially in vertical alignment with said single support leg; and wherein said plurality of cylinders or rollers have their centers of rotation located in an asymmetrical Y configuration, the rollers located in one upper arm of said asymmetrical Y being mounted in one of said arms of said side walls, the rollers located in the other upper arm of said asymmetrical Y being mounted in the other of said arms of said side walls, and the rollers located in the downwardly extending leg of said asymmetrical Y being mounted in the downwardly extending leg of said side walls and comprising a column or post structure (20), located at a far region of said free space, and positioned to support said one upwardly directed arm, which arm is out of alignment with, and remote from said single support leg (3), and the cylinders between the side walls of said one arm;

and guide roller means (18, 19) secured to and retained on said column or post structure (20) and located to guide the web in a rising path (A), said free space (S) being of sufficient size to provide for access by an operator (I) between the column or post structure (20) and said single upright leg (3) of the side wall, and an operator support platform (22) secured to the column or post structure (20).

2. Printing machine according to claim 1, further comprising a further operator support platform (25) secured to the single downwardly extending support leg (3) of the side walls.

3. Printing machine according to claim 1, wherein said cylinders include a plurality of printing cylinders and said impression cylinder is a satellite cylinder, said cylinders being arranged to form a satellite printing system.

4. Printing machine according to claim 3, wherein the printing machine is an offset printing machine; and the cylinders include a cylinder pair (5, 8; 6, 9) located beneath and between both of the upwardly directed arms (2) of the side walls (1) of the printing machine;

a further cylinder pair (7, 10) being located in or adjacent an upper portion of the single upwardly directed leg (3);

and further including inkers and dampers (11, 12; 13, 14; 15, 16) located, respectively, between the upwardly directed arms of the side wall and the single downwardly extending support leg (3) of the side walls, and associated, respectively, with the printing cylinders.

5. Printing machine according to claim 3, further comprising a further operator support platform (25) secured to the single downwardly extending support leg (3) of the side walls.

6. Printing machine according to claim 1, wherein the printing machine is an offset printing machine, and said cylinders include blanket and plate cylinders, and inkers and dampers are provided including at least in part, some of said rollers, the respective inkers and dampers being associated with the plate cylinders;

and wherein said inkers and dampers are located in the regions of the upstanding arms (2) and said single downwardly extending support leg (3) between the side walls (1).

7. Printing machine according to claim 6, wherein said impression cylinder comprises a satellite cylinder (4) located in an essentially central zone in the region of the junction of said arms (2) and said single downwardly extending support leg (3) of the side walls (1).

8. Printing machine according to claim 6, further comprising a further operator support platform (25) secured to the single downwardly extending support leg (3) of the side walls.

* * * * *